United States Patent [19]

Batts et al.

[11] 4,023,762

[45] May 17, 1977

[54] ARTICLE SUSPENSION DEVICE

[75] Inventors: John H. Batts, Grand Rapids; Everett L. Duester, Holland, both of Mich.

[73] Assignee: John Thomas Batts, Inc., Zeeland, Mich.

[22] Filed: Jan. 9, 1976

[21] Appl. No.: 647,731

[52] U.S. Cl. ..... 248/359; 211/113; 223/85; 248/340

[51] Int. Cl.[2] ..... A44B 21/00; A47F 7/08

[58] Field of Search ..... 223/95, 88, 87, 85; 248/340, 339, 359, 360, 301; 211/113, 34, 38; 24/85 B, 16 PB, 84 H

[56] References Cited

UNITED STATES PATENTS

| | | | |
|---|---|---|---|
| 1,270,811 | 7/1918 | Garant | 211/34 |
| 2,206,161 | 7/1940 | Cherne | 223/85 UX |
| 3,255,939 | 6/1966 | Buzzelli | 223/95 UX |
| 3,445,045 | 5/1969 | Panning | 223/95 |
| 3,685,189 | 8/1972 | Conger | 223/95 X |
| 3,755,859 | 9/1973 | Solari | 24/84 B |
| 3,900,181 | 8/1975 | Pitanis | 248/340 |
| 3,907,115 | 9/1975 | Satchell | 211/34 |

FOREIGN PATENTS OR APPLICATIONS

| | | | |
|---|---|---|---|
| 1,148,048 | 5/1963 | Germany | 223/85 |

*Primary Examiner*—J. Franklin Foss
*Attorney, Agent, or Firm*—Price, Heneveld, Huizenga & Cooper

[57] ABSTRACT

A hanger for garments or other articles such as shoes having loops or web-like portions from which said articles may be suspended, included a body member equipped with a hook, the body member being generally of U-shaped configuration when folded for use and having a central web and a pair of wings. Each of the wings defines a slot opening through one end thereof and extending generally horizontally when the hanger is suspended from its hook for engaging the loops or a web-like portion of an article. The upstanding hook is formed integral with the body member to permit suspension of the hanger from a support rod or the like.

18 Claims, 13 Drawing Figures

ARTICLE SUSPENSION DEVICE

BACKGROUND OF THE INVENTION

This invention relates to hook-supported arrangements and, more particularly, to a unique hanger for garments and other articles having web-like portions.

Heretofore, various devices have been proposed and used for the display or storage of various articles of clothing including pants, slacks and shoes. It is fairly common practice to display or store slacks or pants by using hanger-like devices having an elongated, rigid, rod-like member to which are secured clamping elements. The clamping elements engage either the bottom of the slacks or the top of the slacks and the device permits storage or display of the article of clothing from an elongated support rod. An example of one such device may be found in commonly owned U.S. Pat. No. 3,767,092 to Garrison, et al., entitled GARMENT CLAMPING HANGER WITH SLIDABLE LOCKING CLIP issued on Oct. 23, 1973. Clamping type hangers have been found to be unexceptable for use with jeans or other clothing which is fairly stiff and slippery prior to wear and repeated washings. The gripping portions of the clamps are unable to effectively grasp such articles and suspend them from a support.

Also, it has been fairly common practice to employ a more conventional hanger construction with a transversely extending pant rod. This arrangement, besides being fairly expensive for use in the storing of pants in the home or for display purposes, occasionally results in unwanted creases in the slacks or pants if they are improperly folded over the rod portion. Further, rack structures employing a plurality of spaced, parallel rods have been employed for display of pants or slacks at the retail sales level. Such a structure does not generally make efficient use of available floor space. It is not an effective display device. The structure is fairly large, presents difficulties in the removal and reinsertion of the garments due to interference between adjacent garments and, therefore, does not present the pants to the customer in the most advantageous manner.

Therefore, due to these inherent problems in the hangers heretofore employed, a need exists for a simple, inexpensive, easily mass produced hanger-type device capable of effectively suspending such garments and by which the problems heretofore experienced may be substantially alleviated.

Heretofore, various arrangements have also been proposed for the display of shoes to a retail sales customer or for the suspension of shoes in a storage area. Such arrangements have generally taken the form of shelves or rack structures attachable to a support surface or suspendable from an elongated support-type rod. Also, some elaborate, elongated wall shelf arrangements have been employed to display a plurality of shoes to a customer. These arrangements have been relatively expensive, bulky, and not readily rearrangeable to suit the available storage or display space. They have also made inefficient use of available space.

Therefore, a further need exists for a simple, easily mass produced and inexpensive item which would be readily adaptable for the suspension of a pair of shoes from a vertical support surface or from an elongated support rod. Such an arrangement would reduce the costs involved in providing for the display of shoes and the like in stores. Such reduced cost would especially be desirable in the area of large volume retailing.

SUMMARY OF THE INVENTION

In accordance with the present invention, a unique, easily manufactured device is provided for display or storage of articles of clothing having belt loops or web-like portions as in the case of shoes. Essentially, a hanger-like device is provided having a body member of generally U-shaped configuration. The body member including a central web and a pair of generally spaced, parallel, depending wings positioned on each side of the central web and defining an article receiving channel therebetween. An upstanding support engaging member is formed integral with or otherwise suitable attached to the body member for suspending the device from a support rod or the like. Each of the depending wings is bifurcated and, therefore, each defines a slot opening through one end thereof which extends generally parallel to the central web. The article to be displayed or stored is placed within the article channel and the loops or web-like portions of the article are positioned within the slots. The device is moldable as a single, generally planar part and the individual portions are foldable for use.

DETAILED DESCRIPTION OF THE PREFERRED EMBODIMENTS

Figure 1:
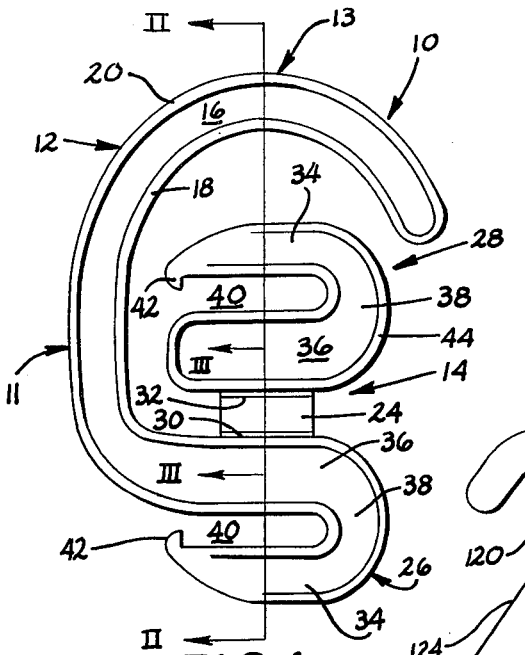
FIG. 1 is a plan view of one form of an article suspension device in accordance with the present invention in its unfolded state.

One form of an article suspension device in accordance with the present invention is illustrated in FIGS. 1–5 and generally designated 10. As best seen in FIG. 1, the device 10 includes a support engaging hook portion 12 and a body portion generally designated 14. The hook portion 12 may take a variety of shapes and is shown for illustrative purposes as including a stem portion 11 and a curved portion 13. In this form, the support hook portion 12 has a generally I-beam cross section (FIG. 2) including a central web 16 and flanges 18, 20. The flanges extend along the lateral edges of the web portion 16. Flanges 18, 20, besides adding to the overall artistic design of the support hook portion, also function to reinforce this portion of the device.

Figure 2:
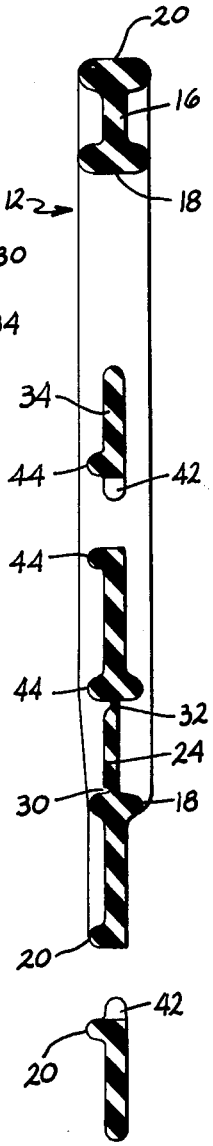
FIG. 2 is an enlarged cross-sectional view taken generally along line II—II of FIG. 1.
Figure 4:
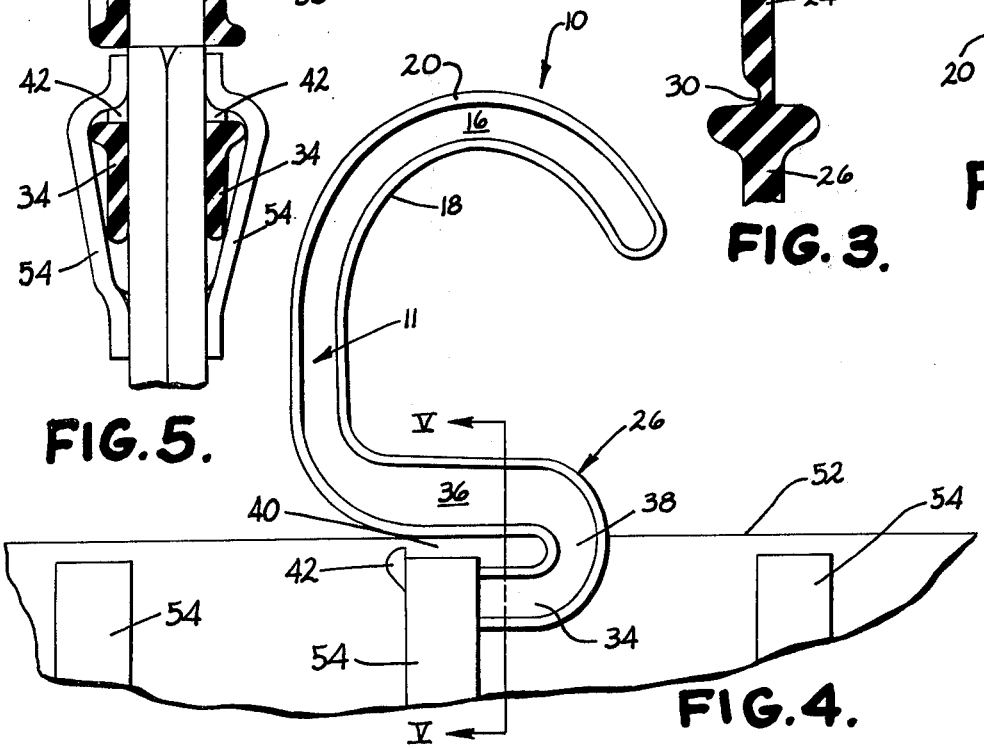
FIG. 4 is a front elevational view showing the manner in which the hanger in accordance with the present invention is employed to suspend an article of clothing which has a plurality of belt loops.

The body portion 14, as best seen in FIG. 1, includes a central web 24 and a pair of wing-like members 26, 28. In the preferred embodiment, the wing-like member 26 is hingedly connected along one lateral edge to the central web 24 and the central web 24 is hingedly connected or joined to the wing-like member 28 along its opposite lateral edge. The preferred manner for accomplishing this hinge-like connection is illustrated in FIGS. 2 and 4. As shown therein, wing member 26 is hingedly joined to the central web 24 by a reduced cross-sectional portion or hinge line portion 30. The central web 24 is hingedly connected to the wing member 28 along a reduced cross sectioned portion or hinge line 32. Reduced cross sectioned portions 30, 32 are easily formed when the device is produced by conventional molding techniques. The central web 24, as will be more fully described below, serves, therefore, to space the wings and hingedly interconnect them for pivotal movement towards and away from each other.

Each wing member 26, 28 is of a bifurcated form having a generally flattened C-shaped configuration. The wing member includes a suspension leg 34 and an upper leg 36 joined by a base 38. Therefore, each wing member 26, 28 defines a loop or web receiving slot 40, opening in a direction generally perpendicular to the hook portion. The end of each suspension leg 34 adjacent the opening of the slots 40 includes an upstanding or inwardly directed tooth-like portion 42. This tooth member 42 assists in retaining the garment within the slot 40 as will be more fully described below.

With the embodiment illustrated in FIGS. 1–5, the support hook 12 is formed integral with the leg 36 of the wing member 26. Also, the flanges 18, 20 continue past the junction of these members and around substantially the entire periphery of the wing member 26. Another reinforcing flange 44 in like manner extends around substantially the entire periphery of wing member 28. The integral flanges 18, 20 and 44 increase the stiffness and rigidity of the unit. The device is therefore better able for withstanding the loads imposed upon it during use. Also, the hook 12 and wing 26 constitute, in effect, a single generally planar member The device 10 illustrated in FIG. 1, due to its general structural arrangement, may be mass produced as a single, flat part using conventional molding techniques and a simple two-piece mold. Since it is preferred that the hinge areas 30, 32 connecting the wings 26, 28 to the central web 24 be of an integral construction, plastic materials are preferably employed in molding the device. The material selected should have sufficient rigidity to withstand the forces imposed upon the device in use and still have sufficient flexibility to withstand repeated flexure of the hinge portions without noticeable signs of fatigue. One resinous material found to possess the desired properties to withstand repeated flexure of the hinge portions is polypropylene, such as Hercules No. 5623. It is important that the material's characteristics include a resistance to elongation or stretching at the hinge lines 30 and 32 under the normally expected operating loads. The material employed may be translucent or it may be color coordinated with the particular article of clothing suspended by the device so as not to detract from the article displayed.

Figure 5:
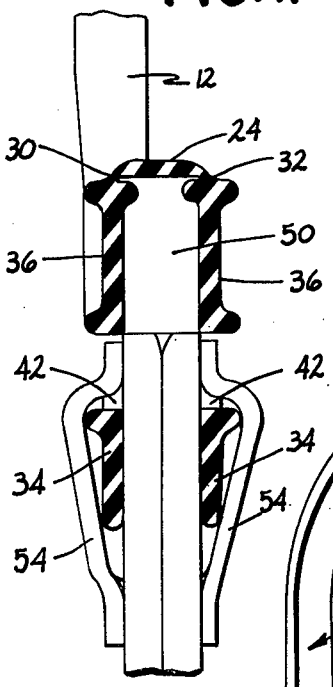
FIG. 5 is a fragmentary, enlarged cross-sectional view taken generally along line V—V of FIG. 4.
Figure 3:
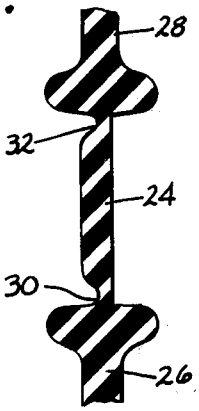
FIG. 3 is an enlarged fragmentary cross-sectional view taken generally along line III—III of FIG. 1.

As best seen in FIGS. 4 and 5 in use, the molded article 10 is folded along the hinge lines 30, 32 so that the wings 26, 28 extend donwardly from the central web 24 in a generally parallel relationship. In effect, the central web 24 acts as a spacing member positioned between the wings of the device. The wing members and the central web thereby define an article or garment receiving channel 50. When so positioned, the device 10 is readily adaptable for the suspension of a pair of slacks, pants or the like 52 which include a plurality of belt-receiving loops 54. The pants 52 are inserted within the channel area 50 and the loops 54 on opposite sides of the pants are placed within the slots 40 of the wing members. Preferably, the centrally positioned loops on the pants are employed for suspending the garment. The upstanding portions 42 of each wing member restrict egress from the slots 40. As seen in FIG. 4, these portions will engage the belt loops and prevent inadvertent displacement of the loops from the slots. Although illustrated as extending longitudinally in a plane generally parallel to the central web 24, the slots may be tilted slightly in a generally upward direction so that the loops 54 of the pants will be urged toward the closed end of the slot under the action of gravity. This slight tilting in conjunction with the upstanding teeth 42 will decrease the chances of inadvertent disengagement of the pants from the suspension device.

The device illustrated in FIGS. 1–5 is primarily intended for use in the display or storage of slacks. The integral hook and wing arrangements permits a plurality of such garments to be suspended transversely of a longitudinally extending support rod. This form of the invention could be used to suspend other articles such as shoes which include an upwardly extending transverse web-like portion in a manner to be more fully described below in connection ith FIGS. 6–11.

An alternative form of the present invention is illustrated in FIGS. 6–11 and generally designated 100. The alternative form is similarly constructed and includes a support engaging member or hook 102 and a body member generally designated 104. The body member likewise includes a central spacer section or web portion 24 and a pair of wing members 26, 28.

Figure 8:
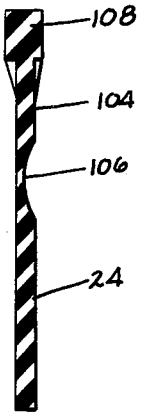
FIG. 8 is an enlarged, cross-sectional view taken generally along line VIII—VIII of FIG. 6.

As with the previous embodiment, each wing member 26, 28 has a generally C-shape and includes legs 34, 36 and base portions 38 which define web receiving slots 40. The wing members 26, 28 are hingedly connected to the central spacer member 24 by integral areas of reduced thickness or hinge lines 30, 32. Also, a reinforcing flange 44 extends around substantially the entire periphery of each wing member. In the alternative embodiment, however, the hook or support engaging portion is not formed integral with one of the legs of the wing members and in effect the hook is rotated through a 90° angle. As shown, the hook 102 includes a lower stem portion 104 which is joined to the spacer member 24 by a hinge member 106. As best seen in FIG. 8, the hinge member 106 is integral with the spacer member 16 along one end thereof and with the stem portion 106 of the hook 102. Hinge member 106 is likewise defined by an area of reduced cross-sectional thickness having a curvature so as to provide sufficient flexibility to permit folding of the hook portion 102 to an erected, generally upright position in a plane normal to the spacer member 24. In other words, the pivotal axis of the hinge member 106 is normal to the pivotal axes of the hinge elements 30, 32.

Figure 6:
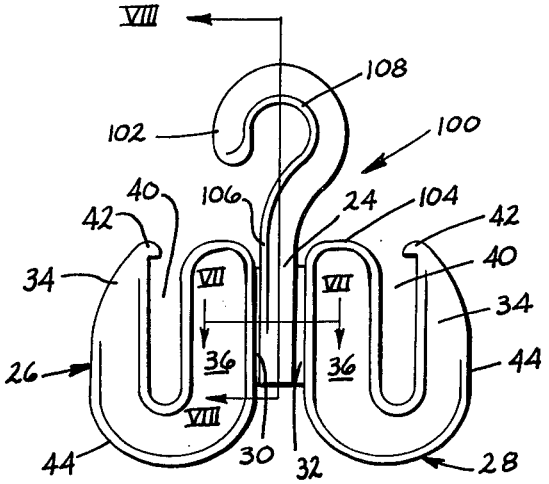
FIG. 6 is a plan view of an alternative form of an article suspension device in accordance with the present invention in its unfolded state.
Figure 7:
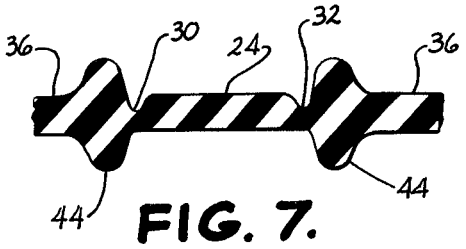
FIG. 7 is an enlarged, cross-sectional view taken generally along the line VII—VII of FIG. 6.
Figure 9:
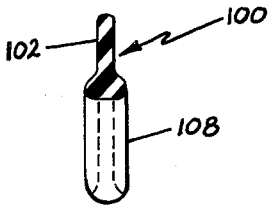
FIG. 9 is a side elevational view of the device of FIG. 6, folded for use.
Figure 9:
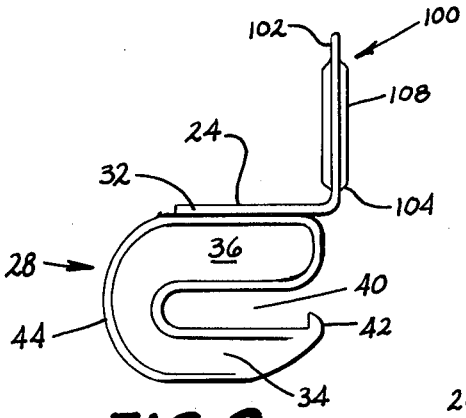

As best seen in FIGS. 6, 8 and 9, a reinforcing rib or flange 108 may be formed integral with the inner, curved peripheral edge of the hook 102. The flange may extend dow to and terminate adjacent the hinge member 106. This flange increases the rigidity of the hook portion so that the device may withstand the forces imposed upon it during use. Also, as with the previous embodiment, an inwardly directed tooth-like portion 42 may be included at the end of each leg 34 of the wing members.

Figure 10:
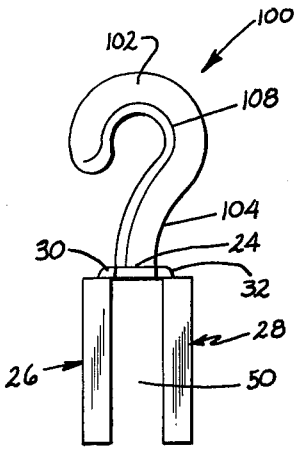
FIG. 10 is a front elevational view of the device of FIG. 9.

As best seen in FIGS. 9 and 10, once the alternative form of the present invention has been molded, the wing memers 26, 28 are easily foldable downwardly to a position where they are generally parallel to each other. The hook portion 102 in a similar manner is foldable to an erected, generally upright position in a plane perpendicular to the plane of the spacer section 24 and perpendicular to the planes of each of the wing members. As a result, the slots 40 in the wing members open in a rearward direction adjacent the support hook.

Figure 11:
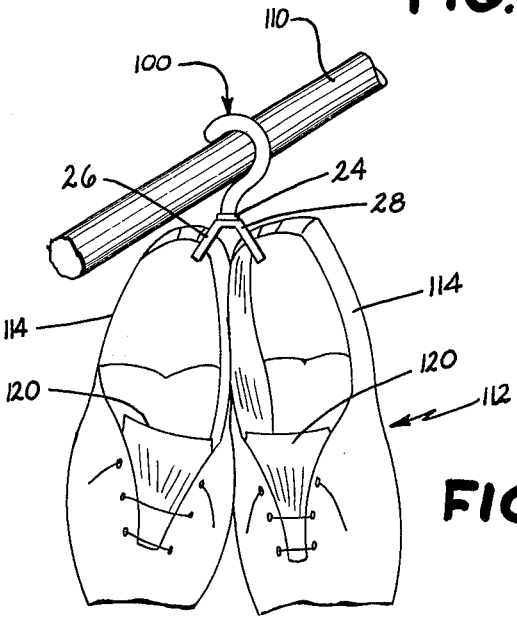
FIG. 11 is a perspective view showing the manner by which the alternative device in accordance with the present invention may be employed to suspend a pair of shoes.

As best seen in FIG. 11, the device 100 is readily adaptable for the display or storage of a pair of shoes from an elongated support rod 110. As shown, a pair of conventional shoes 112 each include an upper portion 114. The shoe upper is a generally thin, wall-like or transverse web-like member. The area of the upper adjacent the heel portion of the shoe is readily insertable within the slots 40 of each wing member 26, 28. The wing members, as with the previously described embodiment, are pivotal toward and away from each other about the spacer section to permit easy insertion of the upper portion of each shoe within the slots.

When each shoe is so inserted into the slots, the upstanding tooth portion 42 formed on the suspension leg 34 of the wing members will engage an inner peripheral surface of this portion of the upper. As a result, the shoe under the action of gravity will tend to pivot about the tip of projection 42 and, thereby, increase the frictional contact between the shoe and the inner peripheral surfaces or spaced, parallel wall areas defined by the legs 26, 28. This arrangement thereby resists separation of the shoes from the wing members when they are suspended by the device.

In the alternative, the device 100 could be employed to suspend the shoes from the tongue or throat portions 120 of the shoes. In either case, a transverse web or wall-like portion of the shoes is engaged by one of the pair of spaced, bifurcated wings. The web-like portion of the shoe is held between the generally parallel webs and will assume a position generally perpendicular to these webs. The individual hangers or support devices 100 may then be suspended along with the shoes in a close, spaced relationship from a common support such as the support rod 110.

As with the previously described pant hanger embodiment, the shoe hanger embodiment of the present invention is an easily and relatively inexpensively mass produced item when compared with display or storage devices heretofore employed. Since the support hook 102 extends upwardly from the spacer member 24 in a plane which is substantially perpendicular to the spacer member and the depending wings when the device is folded, a plurality of different style shoes or the same style of shoes may be supported from the common support rod. This display arrangement therefore reduces the amount of space required for the display of a plurality of shoes. The relationship between the hook and the wings in the embodiment designated 100 is preferred for use as a shoe hanger since the shoes may be readily displayed or stored from a vertical support surface or wall. In this latter case, an individual dowl or stud-like member would be inserted into the wall and thereby extend outwardly therefrom. The hook portion 102 would then be placed over the stud thereby presenting these shoes for ready viewing by a customer. Also, this shoe hanger as with the previously described pants hanger has ready applications in the storage of shoes or other articles in the home. By employing a device in accordance with the present invention, more effective utilization of available closet space may be made by the user.

Figure 12:
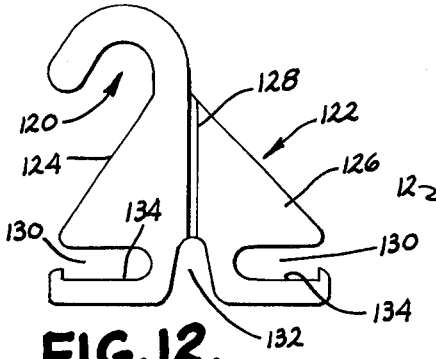
FIG. 12 is a plan view of another alternative embodiment of a suspension device in accordance with the present invention.
Figure 13:
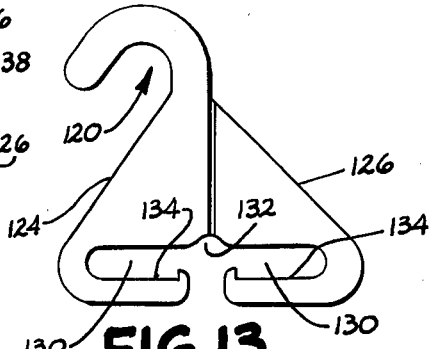
FIG. 13 is a plan view of a further alternative embodiment of a suspension device in accordance with the present invention.

Further alternative embodiments of suspension devices in accordance with the present invention are illustrated in FIGS. 12 and 13. The embodiment of FIG. 12 is similar to that of FIGS. 1–5 in that it includes a support hook 120 and a body member 122. The body member 122 has wing members 124, 126 hingedly joined along their lateral edges by an integral hinge line 128. The support hook 120 is molded integral with the wing member 124 so that these portions constitute a single planar member. The wing members 124, 126 define open ended slots 130 which are engageable with loops or web-like portions of the article to be suspended. The slots are mirror images of one another.

A recess 132 is centered about the wing elements and forms an opening extending from the side of each element towards the hook and between the slots. The depth of the slot is sufficient to create an open passage or article receiving channel between the slots. When the device of FIG. 12 is used to hang slacks from belt loops, the depth of the recess must be at least a distance greater than the spacing of the lower wall 134 of the slots from the side of the wing elements opposite the hook.

The embodiment of FIG. 13 is similar to that of FIG. 12 except slots 130 formed in wing members 124, 126 open or extend toward each other. The slots 130 in the embodiment of FIG. 13, therefore, open into or communicate with the recess 132.

When folded, these embodiments will define a generally U-shaped article receiving channel between the wing members as with the previously described embodiments. The wing members are pivotal towards and away from each other and, in use, the slots will extend in a generally horizontal plane.

The preferred construction of a device in accordance with the present invention, however, would employ a spacing web and a pair of integral hinge elements as the hinge means joining the wing members. The spacer increases the article receiving channel area and thereby increases the ease with which the device may be employed. The spacer also permits a reduction in the transverse dimension of each wing member.

Therefore, it can be seen that the unique hangers in accordance with the present invention are readily adaptable to the mass display or storage of pants and/or shoes. The device is relatively inexpensive and easily manufactured especially when compared with the more complex and bulky rack structures heretofore employed.

In either form, the hanger may be produced as a flat, one-piece part with all of the elements positioned in essentially a common plane. The wings are pivotable about the lateral edges of the central spacer so as to accommodate various size pants, shoes, shirts or any articles which are so constructed that they may be gripped by insertion in the slots of the wing members. It is expressly intended, therefore, that the above description should be considered as that of the preferred embodiment only. The true spirit and scope of the present invention will be determined by reference to the appended claims.

The embodiments of the invention in which an exclusive property or privilege is claimed are defined as follows:

1. An article suspending device comprising: a body member of U-shaped configuration having a central web and a pair of generally spaced parallel depending wings, one on each side of said central web and defining an article channel therebetween; a support engaging member secured to said body member for supporting said body member; each of said wings being bifurcated and defining a slot opening through one end and extending generally parallel to said central web for engaging the article positioned between said wings, said wings and central web being integral and joined by hinge elements, said support engaging member being a hook integral with said body member whereby said hanger can be molded of plastic material as a single flat part and subsequently folded into operating configuration.

2. An article suspending device as described in claim 1 wherein said bifurcated wings each include a lower suspension leg and an upper leg, each of said upper legs being integral with said hinge elements.

3. An article suspending device as described in claim 2 wherein each of said suspension legs of said wings includes an upstanding tooth-like portion adjacent the opening of said slot.

4. An article suspending device as described in claim 3 further including a reinforcing flange extending around a portion of the periphery of each of said wings.

5. An article suspending device as described in claim 4 wherein said hook has a generally I-beam cross section including a planar web and a reinforcing flange extending along each of the lateral edges of said planar web.

6. A hanger for garments having loops from which they can be suspended, said hanger comprising a body member having a central portion and a pair of wing members and a pair of hinge elements each joining one of said wing members to said central portion; each of said wing members being bifurcated and defining a slot opening through one end thereof and extending generally parallel to said central portion; a hook integral with one of said wing members; said wing members extending downwardly from said central portion in spaced generally parallel relationship; said hook projecting upwardly from said wing member and central portion in the plane of said wing member for suspending said wing members with their slots extending generally horizontally for seating through the loops of a garment positioned between said wings.

7. A hanger as defined by claim 6 further including a reinforcing flange extending along the edges of said hook and said wing members.

8. A hanger as defined in claim 6 wherein each of said bifurcated wing members includes an upstanding tooth portion positioned adjacent the opening of said slot.

9. A hanger as defined by claim 6 wherein each of said hinge elements comprises an area of reduced cross section formed integral with said central portion and one of said wing members.

10. A one-piece, integral hanger for garments having belt loops from which said garments are suspended, said hanger comprising:

a generally planar member having an upstanding support engaging portion and an integral loop receiving portion, said loop receiving portion being generally C-shaped and thereby defining a first loop receiving slot, said slot opening in a direction generally perpendicular to said support engaging portion;

a second member having a generally C-shape and thereby defining a second loop receiving slot, said second slot opening in the same direction as said first slot; and a spacing member having a first lateral edge and a second lateral edge, said spacing member being connected to said loop receiving portion of said planar member along said first lateral edge and said spacing member also being connected to said second member along said second lateral edge.

11. A device for suspending a pair of shoes, said device comprising:

a central body member having a spacer section and a hook section hingedly connected to said spacer section, said hook section pivotable about the hinge connection to a plane extending at an angle laterally of said spacer section;

a pair of generally C-shaped wing members each having a pair of legs defining therebetween an elongated slot, said slot extending generally parallel to said spacer section of said central body; and a pair of elongated hinge elements each integral with one edge of a leg of one of said wing members and with a lateral edge of said spacer section, said device being moldable of plastic as a single integral part.

12. A device as defined by claim 11 wherein said hook section is connected to one end of said spacer section and said slots open through said wing members adjacent said hook section, whereby said device may be molded as a single integral part with said central body and said wing members all in essentially a common plane and after molding said wings being foldable to form a pair of shoe engaging hooks and said hook being foldable to extend oppositely from said wings and in a plane normal to said wings.

13. A device for suspending a pair of shoes of the type having a thin wall-like or web-like portion, said device comprising: a body member having a central portion and a pair of wing portions, one on each side of said central portion and hinge elements joining each of said wing portions to said central portion; each of said wing portions being generally U-shaped and having a central elongated slot extending parallel to said central portion and opening through one end; a support engaging member extending outwardly from the end of said central portion adjacent the open ends of said slots; a hinge member joining said support engaging member to said central section, the axis of said hinge member being at a right angle to the axis of said hinge elements, said central portion, wing portions, hinge elements support engaging member and hinge member all being molded from plastic material as a single integral part lying in a common plane, said wing portions being foldable into a generally parallel depending relationship and said hook being foldable into an erected position in a plane normal to said wing portions.

14. A device for suspending a pair of shoes having a thin wall-like member, said device comprising: a body member having a central portion and a pair of wing portions, one on each side of said central portion and integral therewith; each of said wing portions being generally U-shaped and having a central elongated slot parallel to said central portion and opening through one end; a hook integral with and extending upwardly from the end of said central portion adjacent the open ends of said slots, and being in a plane at a right angle to the planes of said wing portions, said wing portions being pivotable toward and away from each other sufficiently to permit each of them to be secured to one shoe of a pair; said hook suspending said central portion and said slots generally horizontally.

15. A one-piece integral article suspending device comprising: a body having a pair of wing elements each having an open ended slot when said article occupies a single plane, the slot in one of said wing members being a mirror image of the slot in the other wing element; hinge means interconnecting said wing elements for folding said wing elements from a planar position to a position in which one face of each of said wing elements is directed generally toward a face of the other thereof and said slots and their open ends are parallel and superimposed for defining a continuous, straight channel therethrough; a supporting hook integral with one of said wing elements adapted to suspend said wing elements with said slots substantially horizontal; said body having a recess therein centered about said wing elements for forming an opening extending from the side of said body opposite from said hook toward said hook between said slots to a depth sufficient to create an open passage between said wing elements spaced from said side at least a distance greater than the spacing of the lower wall of said slots from said side when said wing elements are folded.

16. The one-piece integral article suspending device described in claim 15 wherein the open ends of said slots extend away from each other.

17. The one-piece integral article suspending device described in claim 15 wherein the open ends of said slots extend toward each other and communicate with said recess.

18. The one-piece integral article suspending device described in claim 15 wherein said hinge means has a spacer member for maintaining said wing elements in spaced relationship when said wing elements are folded.

* * * * *